US005350206A

United States Patent [19]

Akahori et al.

[11] Patent Number: 5,350,206

[45] Date of Patent: Sep. 27, 1994

[54] AUTOMOTIVE DOOR LOCK DEVICE

[75] Inventors: Masakazu Akahori; Masaaki Yuge, both of Yokohama, Japan

[73] Assignee: Ohi Seisakusho Co., Ltd., Yokohama, Japan

[21] Appl. No.: 8,160

[22] Filed: Jan. 25, 1993

[30] Foreign Application Priority Data

Jan. 31, 1992 [JP] Japan ..... 4-040683

[51] Int. Cl.[5] ..... E05C 3/26

[52] U.S. Cl. ..... 292/336.3; 292/337; 292/DIG. 23

[58] Field of Search ..... 292/336.3, 225, 235, 292/337, DIG. 23, DIG. 53

[56] References Cited

U.S. PATENT DOCUMENTS

| | | | |
|---|---|---|---|
| 4,679,836 | 7/1987 | Pupillo et al. | 292/337 X |
| 4,762,348 | 8/1988 | Matsumoto | 292/DIG. 23 X |
| 4,762,349 | 8/1988 | Ikeda | 292/DIG. 53 X |
| 4,902,058 | 2/1990 | Ohhashi et al. | 292/337 |
| 4,904,006 | 2/1990 | Hayakawa et al. | 292/336.3 |
| 5,100,185 | 3/1992 | Menke et al. | 292/DIG. 23 X |

FOREIGN PATENT DOCUMENTS

| | | | |
|---|---|---|---|
| 64-21186 | 1/1989 | Japan . | |
| 4080484 | 3/1992 | Japan | 292/DIG. 23 |

*Primary Examiner*—Peter M. Cuomo
*Assistant Examiner*—Jerry Redman
*Attorney, Agent, or Firm*—Foley & Lardner

[57] ABSTRACT

An automotive door lock device comprises a lock proper having a latch mechanism installed therein. A main cover plate is fixed to the lock proper. The main cover plate has therein an interchanger mechanism operatively engaged with the latch mechanism. A socket structure is defined by the main cover plate. The socket structure has a terminal member of the interchanger mechanism exposed to an interior of the socket structure. An auxiliary cover plate has a shape to be detachably held by the socket structure and has an actuating member installed thereto. The actuating member is brought into an operative connection with the terminal member when the auxiliary cover plate is properly held by the socket structure.

9 Claims, 7 Drawing Sheets

AUTOMOTIVE DOOR LOCK DEVICE

BACKGROUND OF THE INVENTION

1. Field of the Invention

The present invention relates in general to door lock devices for motor vehicles, and more particularly, to automotive door lock devices of a type which has an interchanger-installed cover plate fixed to a lock proper for operatively connecting various external controllers, such as, outside door handle, inside door handle, locking knob and the like to a lockable latch mechanism of the lock proper.

2. Description of the Prior Art

Hitherto, various types of door lock devices have been proposed and put into practical use particularly in the field of wheeled motor vehicles.

One of them is shown in Japanese Patent First Provisional Publication 64-21186, which generally comprises a lock proper which has a lockable latch mechanism engageable with a striker fixed to a vehicle body and an interchanger-installed cover plate which is fixed to the lock proper for operatively connecting various external controllers of the door (such as, outside door handle, inside door handle, locking knob and the like) to the lockable latch mechanism of the lock proper.

The lock devices of this type can be commonly and widely used in various doors by only changing the cover plate.

However, the common usage of the lock devices of this type is not available in a field wherein two types of connecting members, viz., rod-type connecting member and cable-type connecting member, are selectively used for connecting the external controllers with the latch mechanism of the lock proper.

SUMMARY OF THE INVENTION

It is therefore an object of the present invention to provide an automotive door lock device which can be used in both one field wherein the rod-type connecting member is used and another field wherein the cable-type connecting member is used.

According to a first aspect of the present invention, there is provided an automotive door lock device which comprises a lock proper having a latch mechanism installed therein; a main cover plate fixed to the lock proper, the main cover plate having therein an interchanger mechanism operatively engaged with the latch mechanism; a socket structure defined by the main cover plate, the socket structure having a terminal member of the interchanger mechanism exposed to an interior of the socket structure; an auxiliary cover plate having a shape to be detachably held by the socket structure and having an actuating member installed thereto, the actuating member being brought into an operative connection with the terminal member when the auxiliary cover plate is properly held by the socket structure; and latch means for achieving a latched engagement between the auxiliary cover plate and the socket structure when the auxiliary cover plate is fully inserted into the interior of the socket structure.

According to a second aspect of the present invention, there is provided an automotive door lock device which comprises a lock proper having a latch mechanism installed therein; a main cover plate fixed to the lock proper, the main cover plate having therein an interchanger mechanism operatively engaged with the latch mechanism; a single socket structure defined by the main cover, the socket structure having a terminal member of the interchanger mechanism exposed to an interior of the socket structure; a first auxiliary cover plate having a shape to be detachably held by the single socket structure and having a first actuating member installed thereto, the first actuating member being brought into an operative connection with the terminal member when the first auxiliary cover plate is properly held by the single socket structure; a second auxiliary cover plate having a shape to be detachably held by the single socket structure and having a second actuating member installed thereto, the second actuating member being brought into an operative connection with the terminal member when the second auxiliary cover plate is properly held by the single socket structure; and latch means for achieving a latched engagement between either one of the first and second auxiliary cover plates and the single socket structure when the one auxiliary cover plate is fully inserted into the interior of the socket structure.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the automotive door lock device of the present invention will be described in detail with reference to the accompanying drawings.

Figure 1:
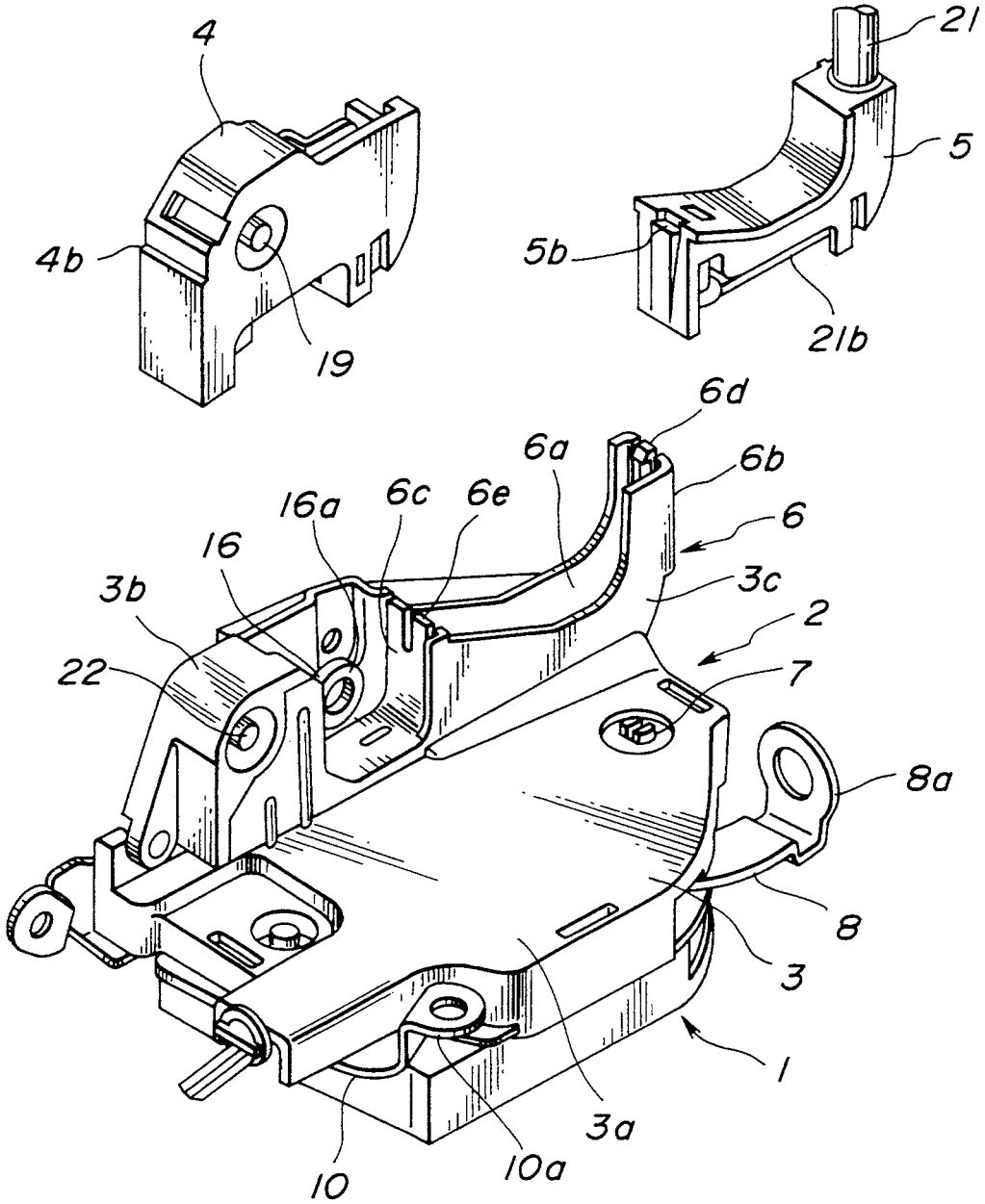
FIG. 1 is a perspective view of an automotive door lock device according to the present invention, showing a condition wherein two types (viz., rod-connector type and cable-connector type) of auxiliary cover plates are separated from a main cover plate.

Referring to the drawings, particularly FIG. 1, there is shown the automotive door lock device according to the present invention.

The lock device generally comprises a lock proper 1 mounted to an automotive door (not shown) and a unique cover plate 2 mounted to the lock proper 1.

The lock proper 1 has therein a known lockable latch mechanism which includes a latch plate engageable with a striker fixed to a vehicle body, and a locking plate engageable with the latch plate to lock the same at the door latching position.

The unique cover plate 2 comprises a main cover plate 3 which is fixed to the lock proper 1 and two auxiliary cover plates 4 and 5 which are selectively coupled with the main cover plate 3.

The auxiliary cover plate 4 is constructed to connect a rod-type connecting member to the lock proper 1, while the other auxiliary cover plate 5 is constructed to connect a cable-type connecting member to the lock proper 1. Thus, hereinafter, these two auxiliary cover plates will be referred to as "rod-connector type auxiliary cover plate" and "cable-connector type auxiliary cover plate" respectively.

As is seen from FIG. 1, the main cover plate 3 comprises a flat major portion 3*a* which is intimately attached to the lock proper 1, and first and second raised portions 3*b* and 3*c* which are formed at one side of the flat major portion 3*a*. The second raised portion 3*c* is formed with a connector part 6 which has a rectangular aperture 6*a* formed therein.

As will become apparent as the description proceeds, with the connector part 6, there is selectively coupled either one of the rod -connector type and cable-connector type auxiliary cover plates 4 and 5.

The connector part 6 comprises opposed larger flat walls (no numerals) and opposed smaller walls 6*b* and 6*c*. The smaller walls 6*b* and 6*c* are respectively formed with resilient pawls 6*d* and 6*e* each being projected inward.

Figure 2:
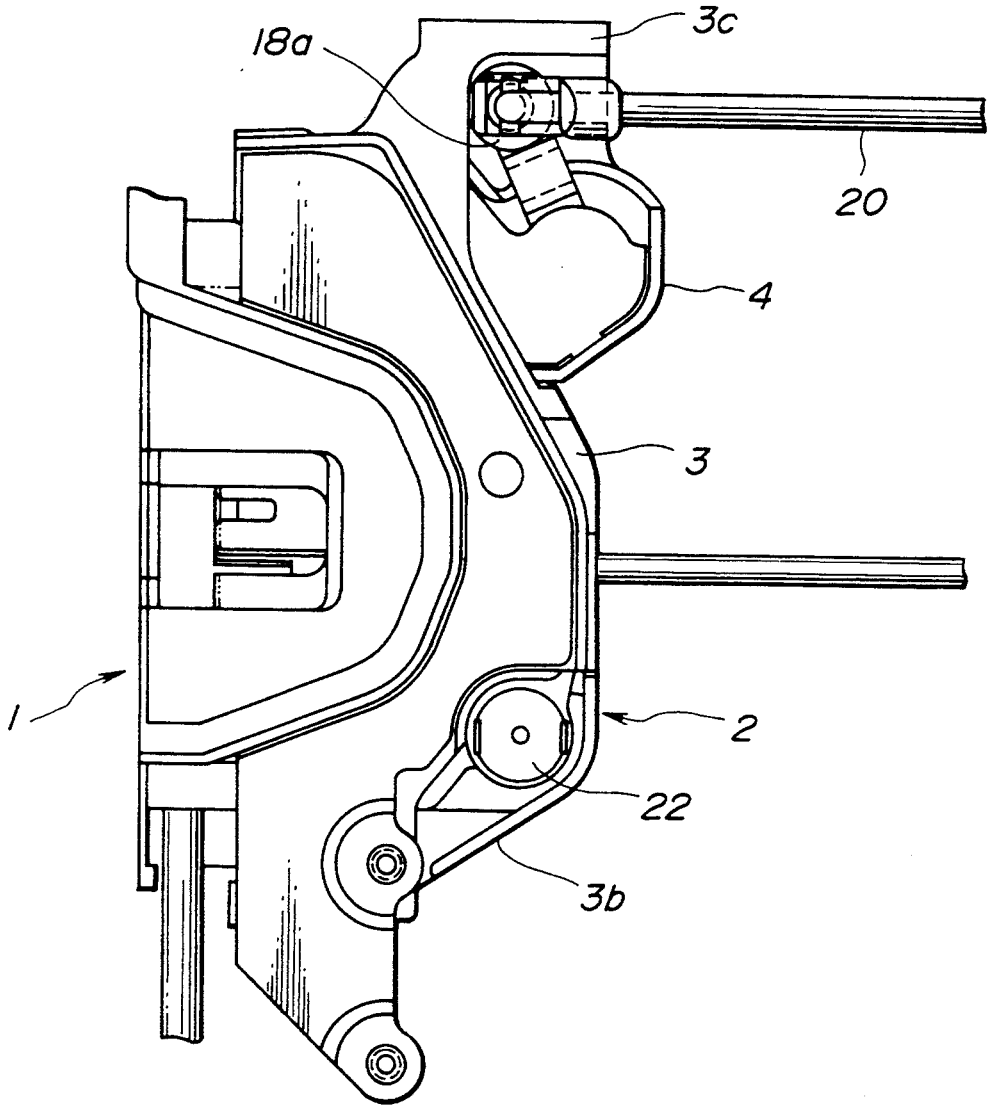
FIG. 2 is a side view of the automotive door lock device having the rod-connector type auxiliary cover plate coupled therewith.
Figure 3:
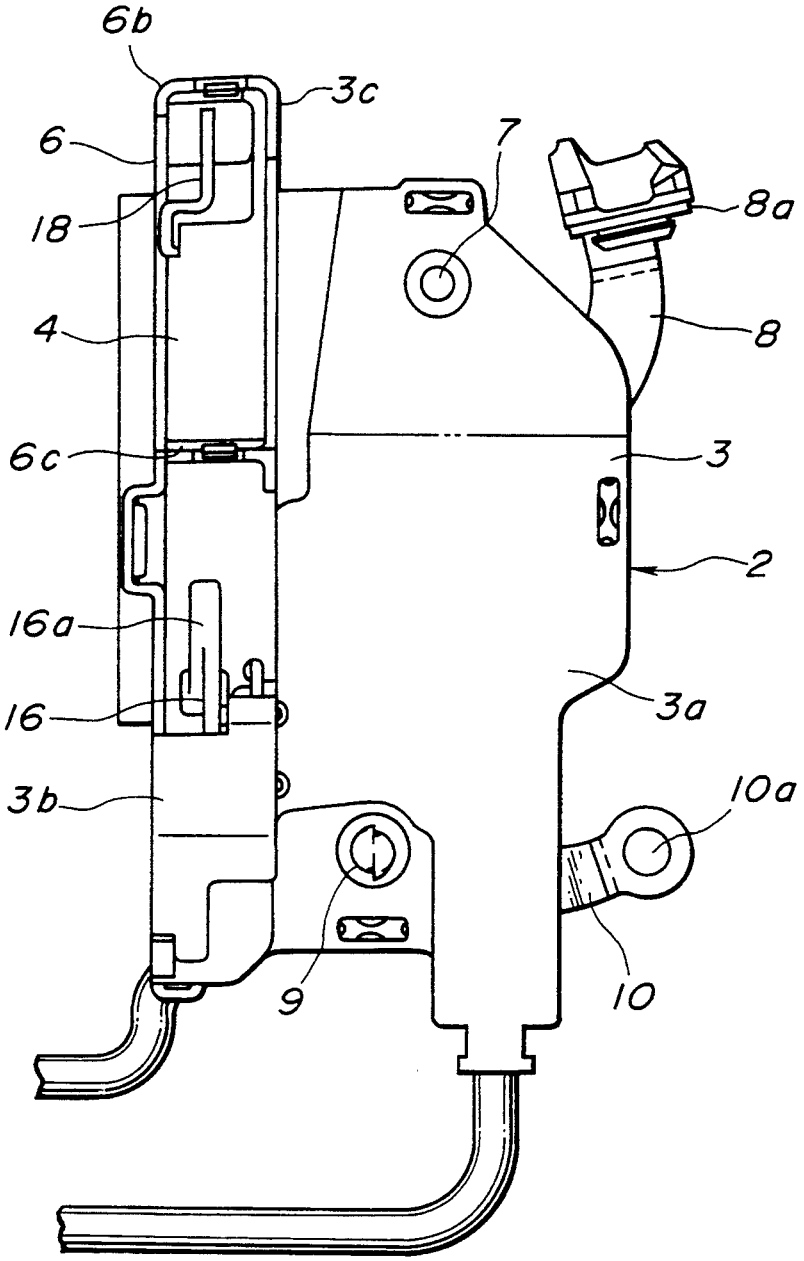
FIG. 3 is a front view of the automotive door lock device in the assembled condition.
Figure 6:
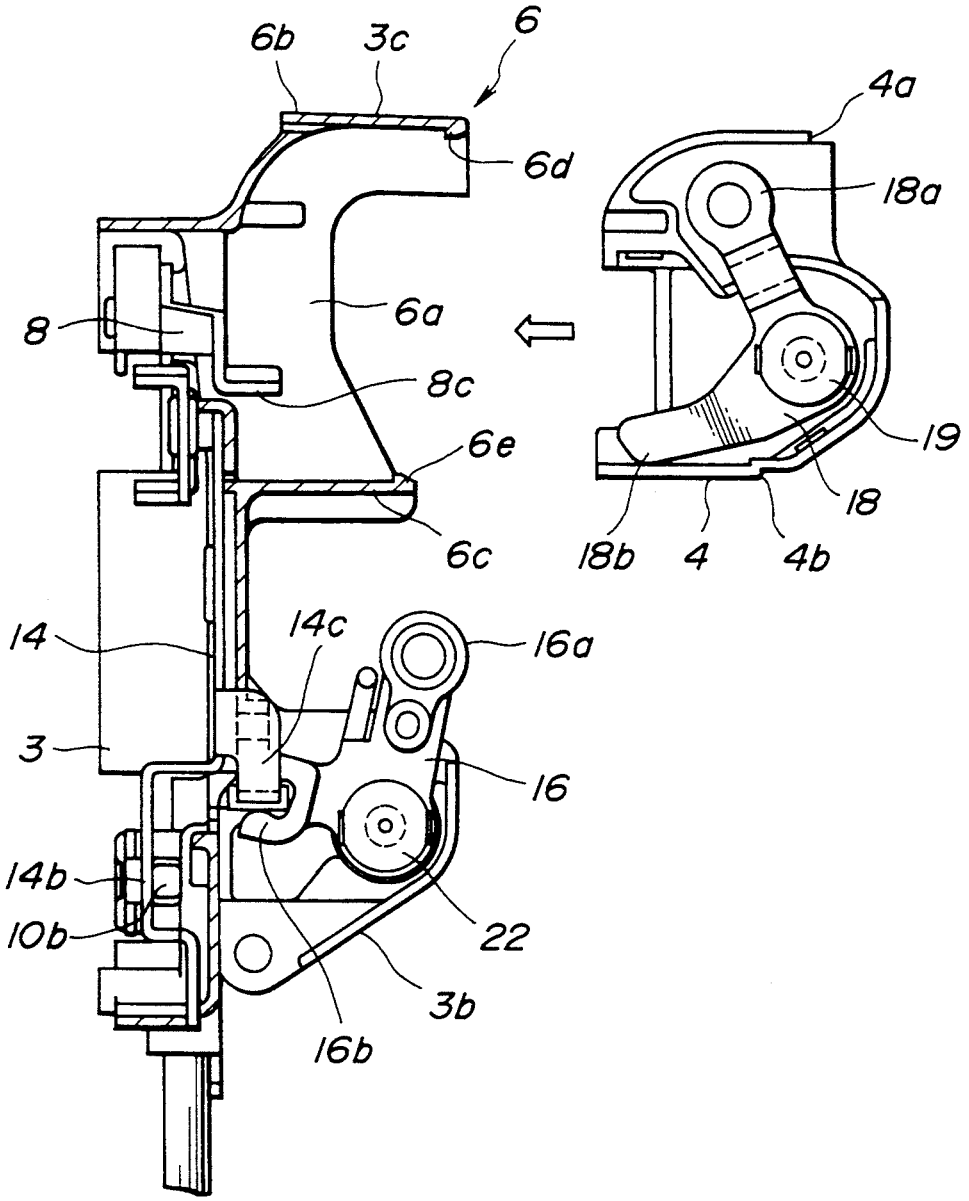
FIG. 6 is a vertically sectional view of the main cover plate having the rod-connector type auxiliary cover plate separated therefrom.

As is seen from FIG. 6, the rod-connector type auxiliary cover plate 4 is shaped to match with the rectangular aperture 6*a* of the connector part 6 of the main cover plate 3. The auxiliary cover plate 4 has opposed side walls which have respective stopper gaps 4*a* and 4*b*. Within the auxiliary cover plate 4, there is pivotally installed through a pivot shaft 19 an inside lever 18 which has one end 18*a* and the other end 18*b*. The one end 18*a* is pivotally connected to a rod type connecting member 20 (see FIG. 2) which extends from a door inside handle (not shown) mounted to the door. As will be described hereinafter, the other end 18*b* of the inside lever 18 is brought into an operative connection with an end portion 8*c* of an after-mentioned outside lever 8 when the auxiliary cover plate 4 is properly coupled with the main cover plate 3.

Figure 8:
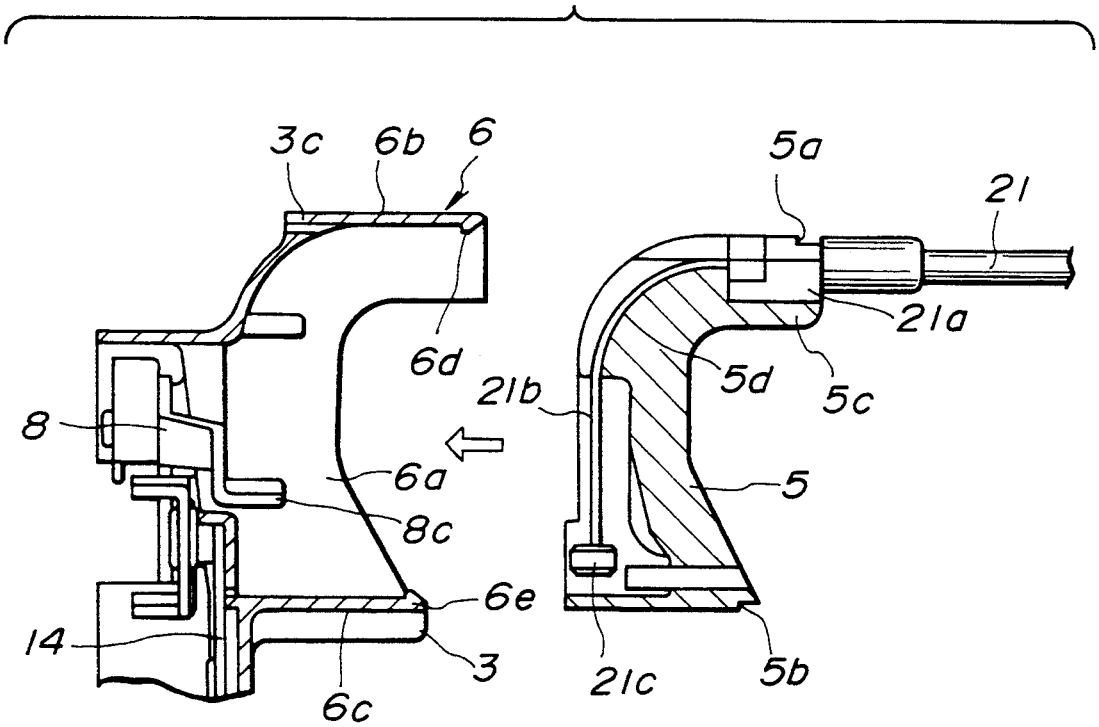
FIG. 8 is a vertically sectional view of the main cover plate having the cable-connector type auxiliary cover plate separated therefrom.

As is seen from FIG. 8, also the cable-connector type auxiliary cover plate 5 is shaped to match with the rectangular aperture 6*a* of the connector part 6 of the main cover plate 3. The auxiliary cover plate 5 has opposed side walls which have respective stopper gaps 5*a* and 5*b*. Within the auxiliary cover plate 5, there are formed a cable retaining portion 5*c* and a curved guide passage 5*d*. The cable retaining portion 5*c* retains an end of an outer casing 21*a* of a cable 21, while the curved guide passage 5*d* slidably receives therein an inner cable 21*b* of the cable 21. The cable 21 extends from the door inside handle mounted to the door. The inner cable 21*b* has at its terminal end a round stopper 21*c* fixed thereto.

Figure 4:
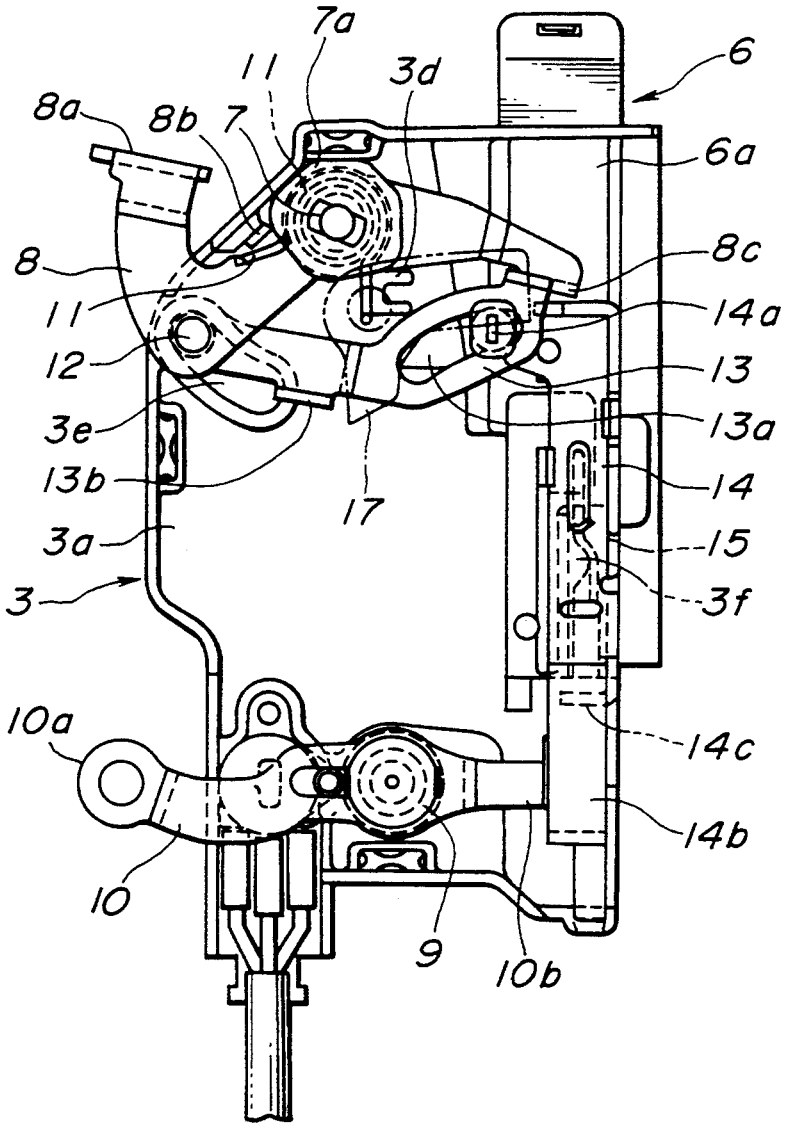
FIG. 4 is a back view of the main cover plate.

As is seen from FIG. 4, the main cover plate 3 is provided, at an inner surface of the flat major portion 3*a* facing the lock proper 1, with both an outside lever 8 which is pivotally connected thereto through a pivot shaft 7 and a first lock lever 10 which is pivotally connected thereto through another pivot shaft 9. The outside lever 8 has one end 8*a* pivotally connected to a rod-like connecting member extending from a door outside handle (not shown) mounted to the door, while the first lock lever 10 has one end 10*a* pivotally connected to a rod-like connecting member extending from a key cylinder (not shown) mounted to the door.

The outside lever 8 is biased to pivot in a clockwise direction in FIG. 4 by a spring The spring 11 has a coiled portion received in a round recess 7*a* defined by the pivot shaft 7. The spring 11 has one end hooked to a raised part 8*b* of the outside lever 8 and the other end hooked to a raised portion 3*d* of the main cover plate 3.

A first sub-lever 13 is pivotally connected at its one end to the outside lever 8 through a pin 12. As shown, the pin 12 is connected to a portion of outside lever 8 defined between the end 8*a* and the pivot shaft 7. The pin 12 has an extension slidably guided by an arcuate guide slot 3*e* formed in the main cover plate 3. The other end portion 8*c* of the outside lever 8 is exposed to the rectangular aperture 6*a* of the connector part 6 of the main cover plate 3.

For the reason which will become apparent hereinafter, the other end portion 8*c* of the outside lever 8 is formed with a vertical slit (not shown).

The first sub-lever 13 is formed at the other end portion thereof with an elongate slot 13*a* with which one end portion 14*a* of a second sub-lever 14 is slidably engaged. The first sub-lever 13 is formed between the pivoted part and the elongate slot 13*a* with an engaging portion 13*b* which is engageable with an open lever 17. The open lever 17 is connected to the locking plate of the lock proper 1 to pivot therewith. The second sub-lever 14 is linearly slidably supported by the main cover plate 3, that is, the second sub-lever 14 is movable upward and downward as viewed in FIG. 4.

As is seen from FIG. 4, the first lock lever 10 has one end 10*b* pivotally connected to the other end portion 14*b* of the second sub-lever 14. Thus, upon operation of the key cylinder of the door, the first and second sub-levers 13 and 14 are moved between their unlocking positions as shown in FIG. 4 and their locking positions (not shown). The locking positions are achieved when the first sub-lever 13 is pivoted clockwise from the position of FIG. 4. The second sub-lever 14 has a waved leaf spring 15 fixed thereto. Upon upward and downward movement of the second sublever 14, the spring 15 resiliently contacts against a raised portion 3*f* of the main cover plate 3 thereby to make the movement in a snap action manner.

Figure 5:
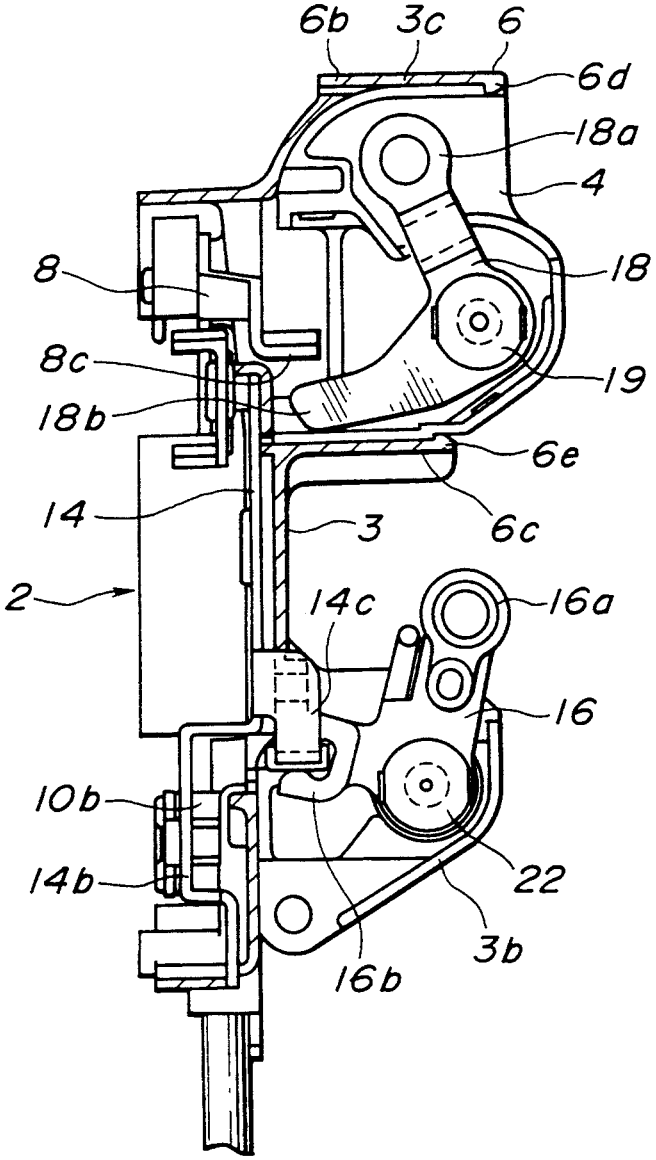
FIG. 5 is a vertically sectional view of the main cover plate with which the rod-connector type auxiliary cover plate is properly coupled.

As is seen from FIG. 5, within the first raised portion 3*b* of the main cover plate 3, there is pivotally installed through a pivot shaft 22 a second lock lever 16. The second lock lever 16 is pivoted between its locking and unlocking positions in response to the pivotal movement of the above-mentioned first lock lever 10. One end portion 16*a* of the second lock lever 16 is pivotally connected to a rod-like connecting member (not shown) which extends from the manual locking knob (or an actuator of a power device) mounted to the door. The other end portion 16*b* of the second lock lever 16 is pivotally connected to a bent portion 14*c* of the second sub-lever 14, so that upon operation of the locking knob, the first lock lever 10 and the first and second sub-levers 13 and 14 are moved between their locking positions and unlocking positions.

In the following, operation of the automotive door lock device of the invention will be described with reference to the drawings, particularly FIG. 4.

For ease of understanding, the description will be commenced with respect to a so-called "unlocked latched condition" of the door wherein the latch plate is fully engaged with the striker to latch the door to the vehicle body. Under this condition, the first and second lock levers 10 and 16 assume their unlocking positions as shown in FIG. 4 and the first and second sub-levers 13 and 14 assume the positions as shown in FIG. 4.

When now the door outside handle is manipulated for the purpose of opening the door, the outside lever 8 is pivoted in a counterclockwise direction in FIG. 4. With this, the first sub-lever 13 is moved rightward having the pin 12 guided by the arcuate guide slot 3*e* of the main cover plate 3. Due to this rightward movement of the first sub-lever 13, the engaging portion 13*b* of the same abuts against and pivots the open lever 17 and thus the latched engagement between the locking plate and the latch plate is canceled. Thus, the door becomes ready for opening.

When, with the first and second lock levers 10 and 16 assuming their unlocking positions as shown in FIG. 4, the key cylinder is manipulated by a key plate from the outside of the door for the purpose of locking the door, the first lock lever 10 is pivoted clockwise in FIG. 4 and thus the second sub-lever 14 is moved downward. With this, the first sub-lever 13 is pivoted clockwise about the pin 12 moving the engaging portion 13*b* thereof away from the traveling path of the open lever 17. Under this condition, manipulation of the door outside handle fails to induce engagement of the engaging portion 13*b* with the open lever. Thus, even when the door outside handle is manipulated, the door can not be opened. It is to be noted that this door locking condition is similarly achieved when the locking knob connected to the second lock lever 16 (see FIG. 6) is manipulated.

In the following, the process for coupling the auxiliary cover plate 4 or 5 (viz., rod-connector type or cable-connector type auxiliary cover plate) with the connector part 6 of the main cover plate 3 will be described with reference to the drawings.

IN CASE OF ROD-CONNECTOR TYPE 4

As is seen from FIG. 6, the auxiliary cover plate 4 is inserted into the rectangular aperture 6*a* of the connector part 6 in the direction of the arrow. When the auxiliary cover plate 4 is fully inserted into the aperture 6*a*, the resilient pawls 6*d* and 6*e* of the connector part 6 are brought into engagement with the stopper gaps 4*a* and 4*b* of the auxiliary cover plate 4 to complete the coupling of the auxiliary cover plate 4 and the main cover plate 3, as is seen in FIG. 5. Upon this, the other end 18*b* of the inside lever 18 is positioned below the end portion 8*c* of the outside lever 8 installed in the main cover plate 3. That is, operative connection between the inside lever 18 and the outside lever 8 is achieved. That is, when the door inside handle is manipulated for the purpose of opening the door, the other end 18*b* of the inside lever 18 raises the end portion 8*c* of the outside lever 8 inducing a counterclockwise movement of the outside lever 8 (see FIG. 8), which causes the door to become ready for opening, as has been mentioned hereinabove.

IN CASE OF CABLE-CONNECTOR TYPE 5

Figure 7:
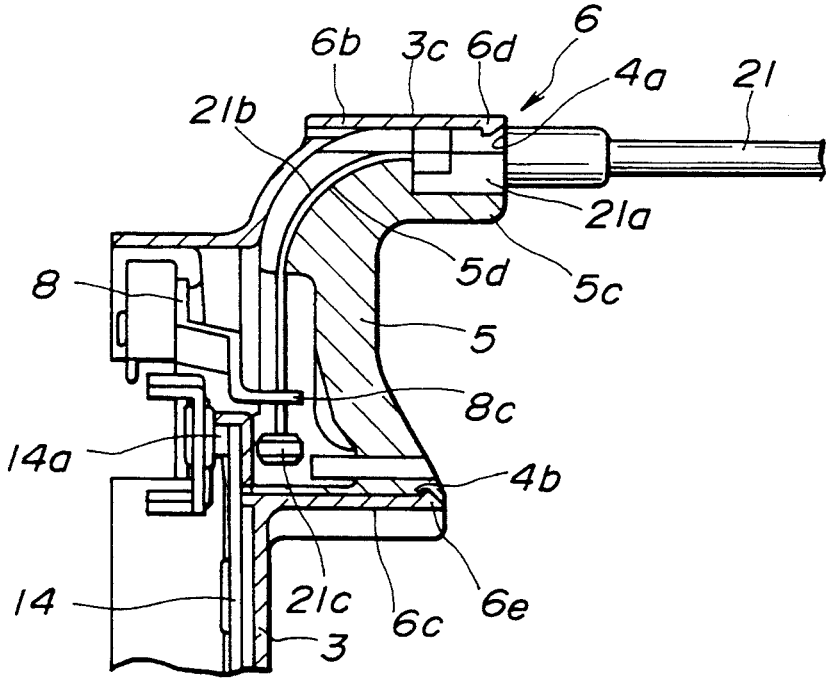
FIG. 7 is a vertically sectional but partial view of the main cover plate with which the cable-connector type auxiliary cover plate is coupled.

As is seen from FIG. 8, the auxiliary cover plate 5 is inserted into the rectangular aperture 6*a* of the connector part 6 in the direction of the arrow. When the auxiliary cover plate 5 is fully inserted into the aperture 6*a*, the resilient pawls 6*d* and 6*e* of the connector part 6 are brought into engagement with the stopper gaps 5*a* and 5*b* of the auxiliary cover plate 5 to complete the coupling of the auxiliary cover plate 5 and the main cover plate 3, as is seen from FIG. 7. Upon this, the terminal end portion of the inner cable 21*b* of the cable 21 is put into the vertical slit of the end portion 8*c* of the outside lever 8 having the round stopper 21*c* left below the end portion 8*c*, as shown. That is, operative connection between the inner cable 21*b* and the outside lever 8 is achieved. That is, when the door inside handle is manipulated for the purpose of opening the door, the round stopper 21*c* of the cable 21 raises the end portion 8*c* of the outside lever 8. As is described hereinabove, such raising causes the door to become ready for opening.

As is understood from the foregoing description, the interchanger-installed cover plate used in the present invention is constructed to connect with either of the rod-type connecting member 20 and the cable type connecting member 21. Thus, the automotive door lock device of the present invention can be commonly and widely used in various types of doors by only selecting the auxiliary cover plate 4 or 5.

What is claimed is:

1. An automotive door lock device comprising:

a lock proper having a latch mechanism installed therein;

a main cover plate fixed to said lock proper, said main cover plate having therein an interchanger mechanism operatively engaged with said latch mechanism;

a socket structure defined by said main cover plate, said socket structure having a terminal member of said interchanger mechanism exposed to an interior of said socket structure;

an auxiliary cover plate having a shape to be detachably held by said socket structure and having an actuating member installed thereto, said actuating member being brought into an operative connection with said terminal member when said auxiliary cover plate is properly held by said socket structure; and latch means for achieving a latched engagement between said auxiliary cover plate and said socket structure when said auxiliary cover plate is fully inserted into the interior of said socket structure.

2. An automotive door lock device as claimed in claim 1, in which said latch means comprises:

two resilient pawls respectively formed on opposed walls of the interior of said socket structure; and means for defining two stopper gaps on said auxiliary cover plate, said resilient pawls being latchingly engaged with said stopper gaps when said auxiliary cover plate is fully inserted into the interior of said socket structure.

3. An automotive door lock device as claimed in claim 2, in which auxiliary cover plate comprises:

a body structure having a shape matched with the interior of said socket structure; and an L-shaped lever pivotally connected to said body structure, said lever having one end portion which serves as said actuating member and the other end portion to which a rod-type connecting member is to be pivotally connected.

4. An automotive door lock device as claimed in claim 3, in which said one end portion of said L-shaped lever is positioned below said terminal member when said auxiliary cover plate is properly held by said socket structure.

5. An automotive door lock device as claimed in claim 2, in which said auxiliary cover plate comprises:

a body structure having a shape matched with the interior of said socket structure; and means for defining in said body structure a cable guide passage through which a cable-type connecting member is to be slidably received, said cable-type connecting member serving as said actuating member.

6. An automotive door lock device as claimed in claim 5, in which said cable-type connecting member has at its terminal end a round stopper fixed thereto, said cable-type connecting member being received in a slit formed in said terminal member having said round stopper left below said terminal member, when said auxiliary cover plate is properly held by said socket structure.

7. An automotive door lock device comprising:

a lock proper having a latch mechanism installed therein;

a main cover plate fixed to said lock proper, said main cover plate having therein an interchanger mechanism operatively engaged with said latch mechanism;

a single socket structure defined by said main cover, said socket structure having a terminal member of said interchanger mechanism exposed to an interior of said socket structure;

a first auxiliary cover plate having a shape to be detachably held by said single socket structure and having a first actuating member installed thereto, said first actuating member being brought into an operative connection with said terminal member when said first auxiliary cover plate is properly held by said single socket structure;

a second auxiliary cover plate having a shape to be detachably held by said single socket structure and having a second actuating member installed thereto, said second actuating member being brought into an operative connection with said terminal member when said second auxiliary cover plate is properly held by said single socket structure; and latch means for achieving a latched engagement between either one of said first and second auxiliary cover plates and said single socket structure when the one auxiliary cover plate is fully inserted into the interior of said socket structure.

8. An automotive door lock device as claimed in claim 7, in which said first auxiliary cover plate includes a body structure having a shape matched with the interior of said socket structure and an L-shaped lever pivotally connected to said body structure, said L-shaped lever having one end portion which serves as said first actuating member and the other end portion to which a rod-type connecting member is to be pivotally connected.

9. An automotive door lock device as claimed in claim 8, in which said second auxiliary cover plate includes a body structure having a shape matched with the interior of said socket structure; and means for defining in said body structure a cable guide passage through which a cable-type connecting member is to be slidably received, said cable-type connecting member serving as said actuating member.

* * * * *